US005470004A

United States Patent [19]

Mineki

[11] Patent Number: 5,470,004

[45] **Date of Patent: * Nov. 28, 1995**

[54] SEPARATING APPARATUS FOR A PUNCHED SHEET

[75] Inventor: Ryohachi Mineki, Tokyo, Japan

[73] Assignee: Takayoshi Mineki, Tokyo, Japan

[ * ] Notice: The portion of the term of this patent subsequent to Jun. 15, 2010, has been disclaimed.

[21] Appl. No.: 134,303

[22] Filed: Oct. 8, 1993

[30] Foreign Application Priority Data

Oct. 14, 1992 [JP] Japan ..... 4-276256
Sep. 1, 1993 [JP] Japan ..... 5-217465

[51] Int. Cl.[6] ..... B26F 3/02

[52] U.S. Cl. ..... 225/99; 225/103

[58] Field of Search ..... 225/99, 100, 103; 83/370, 337; 493/342, 373

[56] References Cited

U.S. PATENT DOCUMENTS

| | | | |
|---|---|---|---|
| 3,174,316 | 3/1965 | Sigal | 83/370 |
| 3,670,939 | 6/1972 | Mueller, Jr. | 225/99 |
| 3,916,744 | 11/1975 | West | 83/337 |
| 4,096,981 | 6/1978 | Martorano | 225/99 |
| 4,226,352 | 10/1980 | Watson | 225/100 |
| 4,461,415 | 7/1984 | Seragnoli | 225/98 |
| 4,669,644 | 6/1987 | Nilsson | 225/99 |
| 5,219,108 | 6/1993 | Mineki | 225/99 |

FOREIGN PATENT DOCUMENTS

| | | |
|---|---|---|
| 0509443 | 10/1992 | European Pat. Off. . |
| 564271 | 11/1932 | Germany . |
| 1953406 | 6/1971 | Germany . |
| 1377443 | 12/1974 | United Kingdom . |

*Primary Examiner*—Kenneth E. Peterson
*Attorney, Agent, or Firm*—Ladas & Parry

[57] ABSTRACT

There are provided a feed roller 1 for feeding a punched sheet and a press roller 6 disposed above the feed roller 1, which elastically pinch a tip end portion of the punched sheet 2 fed between the rollers. An actuator 7 actuates the press roller 6 to move along a circumferential surface of the feed roller 1 at the same speed as that of the punched sheet 2, whereby a portion 2*a* surrounded by cuts is separated from the punched sheet 2.

20 Claims, 13 Drawing Sheets

SEPARATING APPARATUS FOR A PUNCHED SHEET

BACKGROUND OF THE INVENTION

The present invention relates to a separating apparatus for separating a portion surrounded by intermittent cuts from a punched sheet, which was processed to have the intermittent cuts for example by a label punching machine such as a platen punching machine.

For example, labels are obtained by punching a label original sheet with intermittent prints applied on the surface thereof. The label original sheet with intermittent prints on the surface thereof is placed between a cutter plate and a support plate in a puncher. Then the cutter plate is urged against the support plate to form intermittent cuts surrounding each label portion in the label original sheet with intermittent prints on the surface thereof. The label original sheet with intermittent cuts surrounding each label portion is taken out of the puncher. A plurality of label original sheets are stacked on each other. Then the stacked label original sheets are pressed at the label portions by a manual operation using a hammer or the like or by a pushing machine provided with push plates corresponding to the label portions, whereby the label portions are separated from the label original sheets.

The separation of press-off label portions in the label original sheet therefrom requires means for taking out of the label puncher the label original sheets after being cut by the label puncher and then stacking the label original sheets on each other, and means for manually or mechanically pressing the press-off label portions in the stacked label original sheets. In other words, there are two independent steps necessary for separating the press-off label portions from the label original sheets, that is, a step of taking out the label original sheets of the puncher and stacking them on each other and a step of separating the label portions from the stacked label original sheets.

There are disadvantages in such an arrangement that the press-off label portions in the label original sheets are separated from the label original sheets by the two steps. If the label original sheets include label portions to be separated therefrom of the same size, shape and location, the two steps can be continuously carried out by locating the pushing machine with push plates corresponding to the label portions, next to the label original sheets stacked in a multiplicity of layers. If there are various kinds of label portions with different sizes, shapes and locations to be pressed off from a small number of label original sheets, the label original sheets must be stacked according to the size, shape and location of the press-off label portions and push plates of different types corresponding to the sizes, shapes and locations of the label portions in the stacked label original sheets must be exchanged therebetween depending upon the stacked label original sheets, which does not allow continuous execution of the two steps.

Applicant developed a separating apparatus for punched sheet disclosed in U.S. Pat. No. 5,219,108 in which a press roller is disposed above a feed roller for feeding a punched sheet, as being freely contactable with or separatable from the feed roller, the punched sheet being fed between the press roller and the feed roller and pinched thereby, and the press roller is moved along a circumferential surface of the feed roller to separate portions surrounded by cuts from the punched sheet.

The separating apparatus for punched sheet can automatically and positively separate the press-off portions from the punched sheet taken out of the puncher regardless of the size and the location of press-off portions in the punched sheet. However, the press roller is not in a rotating motion but in a reciprocating motion relative to the feed roller, and the apparatus needs a device for urging the press roller against the feed roller. Since the apparatus requires a plurality of steps for separating the press-off portions from the punched sheet, there is a limit in the speed of separating the press-off portions from the punched sheet.

Further, the separating apparatus of the above type for punched sheet has the following drawback. If the width of a scrap portion located outside the press-off portions in the punched sheet, that is, a frame portion of the punched sheet (scrap portion left after separation of press-off portions from the punched sheet) is wide, the frame portion of the punched sheet lacks flexibility, which would cause the frame portion of the punched sheet not to move along the feed roller upon separation of punched sheet. This could cause skidding of the feed roller, so that the rear end of the scrap portion in the feed direction could sometimes fail to be fed between the feed roller and the press roller.

SUMMARY OF THE INVENTION

The present invention has been accomplished taking the above-described deficiencies into consideration, and it is an object of the present invention to provide a separating apparatus for punched sheet which enables high-speed separation of press-off portions from a punched sheet taken out of a puncher, regardless of the size, the shape and the location of press-off portions in the punched sheet.

A first feature of a separating apparatus for a punched sheet having a portion surrounded by cuts according to the present invention comprises: a feed roller for feeding the punched sheet; a press roller disposed above the feed roller to elastically pinch with the feed roller a tip portion of the punched sheet fed therebetween; a connector for rotating the press roller and the feed roller at the same surface speed; and an actuator for actuating the press roller to move along a circumferential surface of the feed roller at the same speed as that of the punched sheet to separate the portion surrounded by the cuts from the punched sheet.

A second feature of a separating apparatus for a punched sheet having a portion surrounded by cuts according to the present invention comprises a feed roller for feeding the punched sheet; a rotation support plate disposed to support both sides of the feed roller; a pair of press rollers journaled on the rotation support plate at an angle of 180 degrees from each other; a connector for rotating the press rollers and the feed roller at the same surface speed; and an actuator connected to the rotation support plate to rotate the rotation support plate such that the press rollers move along a circumferential surface of the feed roller at the same speed as that of the punched sheet.

A third feature of a separating apparatus for punched sheet having a portion surrounded by cuts according to the present invention comprises a feed roller for feeding the punched sheet; a press roller disposed above the feed roller to elastically pinch with the feed roller a tip portion of the punched sheet fed therebetween; a connector for rotating the press roller and the feed roller at the same surface speed; a separation helping device for helping in the separation of a portion surrounded by cuts from the punched sheet in cooperation with the press roller; and an actuator for actuating the press roller and the separation helping device to move along a circumferential surface of the feed roller at the same speed as that of the punched sheet to separate the portion surrounded by the cuts from the punched sheet.

A fourth feature of a separation apparatus for a punched sheet having a portion surrounded by cuts according to the present invention comprises a feed roller for feeding the punched sheet; a rotation support plate disposed at one side of the feed roller; a pair of press rollers journaled on the rotation support plate at an angle of 180 degrees from each other; a connector for rotating the press rollers and the feed roller at the same surface speed; a pair of separation helping devices supported on the rotation support plate at an angular spacing of 180 degrees to help in the separation of a portion surrounded by cuts from the punched sheet in cooperation with the press rollers; and an actuator connected to the rotation support plate to rotate the rotation support plate so as to move the pair of press rollers and the pair of separation helping devices along a circumferential surface of the feed roller at the same speed as that of the punched sheet.

In the first feature of the separating apparatus for the punched sheet according to the present invention, the tip portion of the punched sheet fed to the feed roller is pinched between the feed roller and the press roller, and the press roller is moved along the circumferential surface of the feed roller at the same speed as that of the punched sheet while pinching the punched sheet between the rollers, whereby press-off portions are separated from the punched sheet, the separated press-off portions being transferred in the horizontal direction while the scrap portion of punched sheet is dropped down below the feed roller.

In the second feature of the separating apparatus for the punched sheet according to the present invention, a pair of press rollers are provided relative to a feed roller at an angular spacing of 180 degrees, the tip portion of the punched sheet fed to the feed roller is pinched between one of the press rollers and the feed roller, the actuator actuates the pair of press rollers to move along the circumferential surface of the feed roller to separate the press-off portion from the punched sheet, the separated press-off portions are transferred in the horizontal direction, the scrap portion of punched sheet is dropped down below the feed roller, the actuator further actuates the pair of press rollers to move along the circumferential surface of the feed roller to locate the other one of press rollers at the initial position relative to the feed roller, on the path of rotation of the other press roller it flips up the rear end of the scrap portion of the punched sheet thereby to prevent the feed roller from skidding on the scrap portion of the punched sheet, whereby the scrap portion of the punched sheet is positively dropped down below the feed roller, and the pair of press rollers are rotated with respect to the feed roller in the same direction thereby to enable higher-speed operation.

In the third feature of the separating apparatus for punched sheet according to the present invention, the tip portion of the punched sheet fed to the feed roller is pinched between the feed roller and the pres roller, the press roller and the separation helping device are moved along the circumferential surface of the feed roller at the same speed as that of the punched sheet while pinching the punched sheet between the rollers thereby to separate the press-off portions from the punched sheet, the thus separated press-off portions are transferred with guidance by the separation helping device in the horizontal direction, and the scrap portion of punched sheet is dropped down below the feed roller. In this case, the provision of the separation helping device can positively separate even a press-off portion short in length from the punched sheet.

In the fourth feature of the separating apparatus for the punched sheet according to the present invention, a pair of press rollers are provided relative to a feed roller at an angular spacing of 180 degrees, the tip portion of the punched sheet fed to the feed roller is pinched between one of the press rollers and the feed roller, the actuator actuates the pair of press rollers to move along the circumferential surface of the feed roller to separate the press-off portions from the punched sheet, the separated press-off portions are transferred in the horizontal direction, the scrap portion of the punched sheet is dropped down below the feed roller, the actuator further actuates the pair of press rollers to move along the circumferential surface of the feed roller to locate the other one of press rollers at the initial position relative to the feed roller, in the path of rotation of the other press roller it flips up the rear end of the scrap portion of the punched sheet thereby to prevent the feed roller from skidding on the scrap portion of the punched sheet, whereby the scrap portion of the punched sheet is positively dropped down below the feed roller, and the pair of press rollers are rotated with respect to the feed roller in the same direction thereby to enable high-speed operation.

DETAILED DESCRIPTION OF THE INVENTION

First Embodiment

The first embodiment of the present invention will be described in detail with reference to the drawings.

Figure 1:
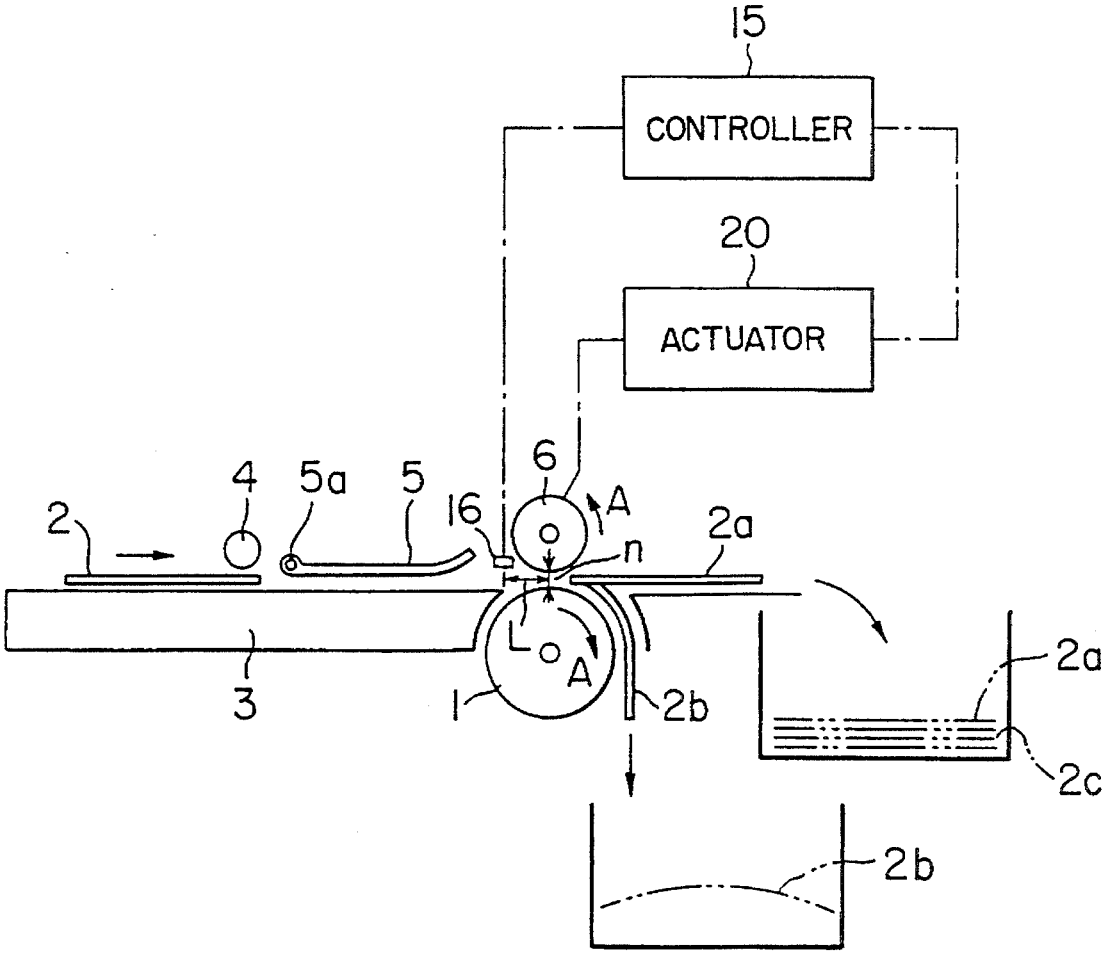
FIG. 1 is a schematic drawing to show a first embodiment of separating apparatus for punched sheet according to the present invention.

In FIG. 1, reference numeral 1 denotes a rotation roller (feed roller) in a separating apparatus for punched sheet. The rotation roller 1 is rotatably supported in the main body (not shown) of the apparatus. The rotation roller 1 is constantly rotated by a motor 25 in the direction of arrow A. Metal powder such as tungsten powder is deposited over the circumferential surface of the rotation roller 1 so as to positively transfer a punched sheet 2 fed thereto. Also, transfer roller 4 and a press plate 5 are disposed above a feed table 3 placed on the upstream side of the rotation roller 1, so that the punched sheet 2 to be processed may be fed to the rotation roller 1 between the transfer roller 4 and the feed table 3 and along the feed table 3 while being forced by the press plate 5. The press plate 5 is supported by a pin 5a on the upstream side in the feed direction so as to be vertically rockable.

Figure 1A:
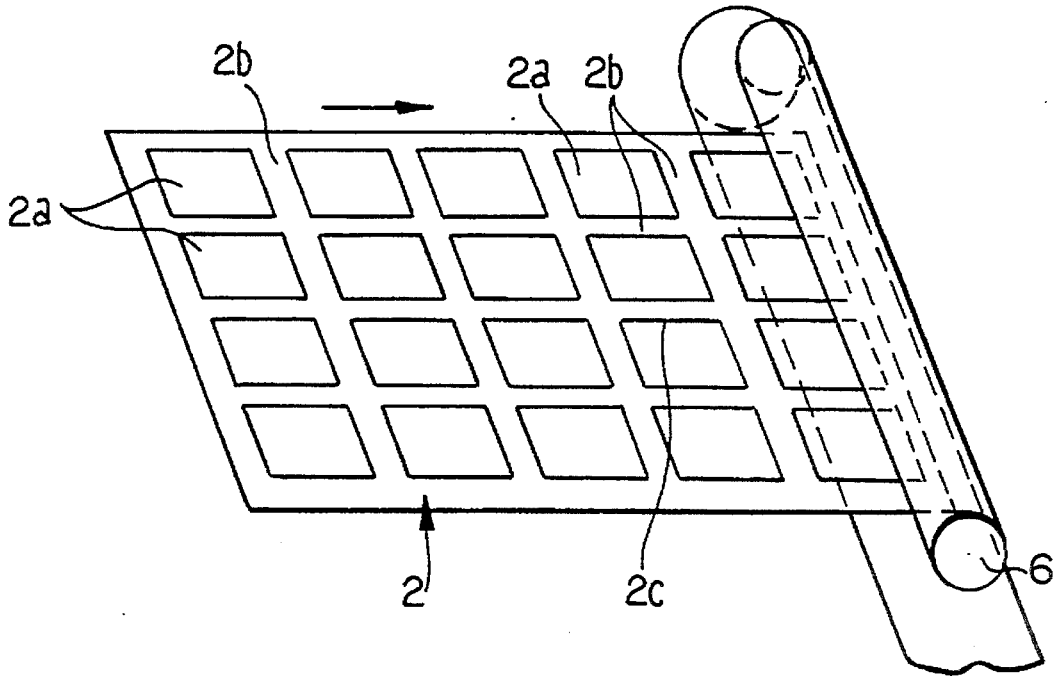
FIG. 1A is a perspective view illustrating a portion of the apparatus of FIG. 1 with a punched sheet.
Figure 2:
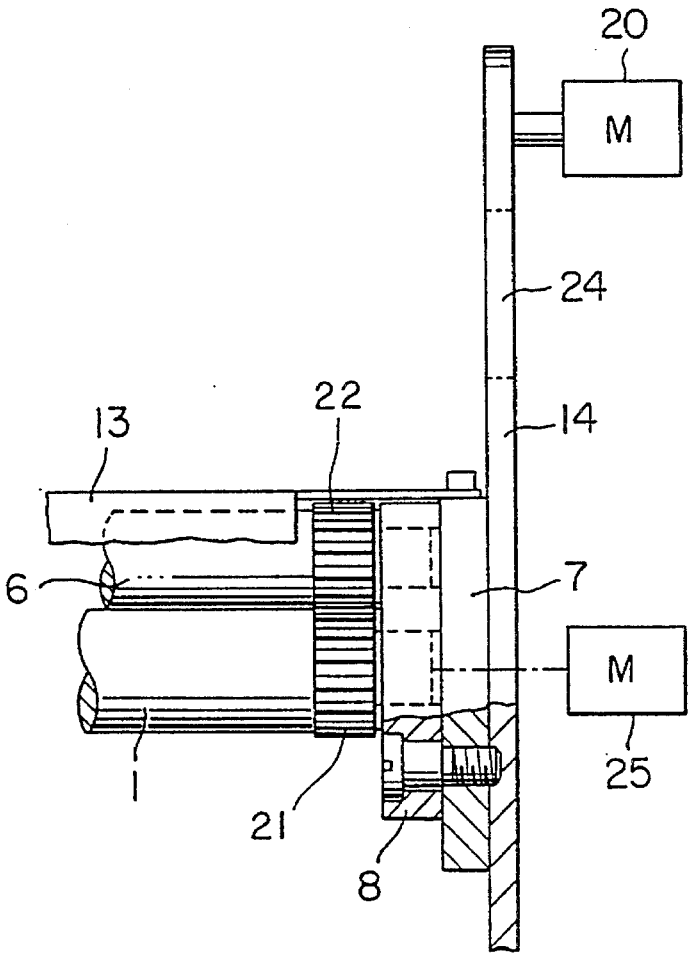
FIG. 2 is an end view showing the main portion of the separating apparatus for punched sheet according to the present invention.
Figure 3:
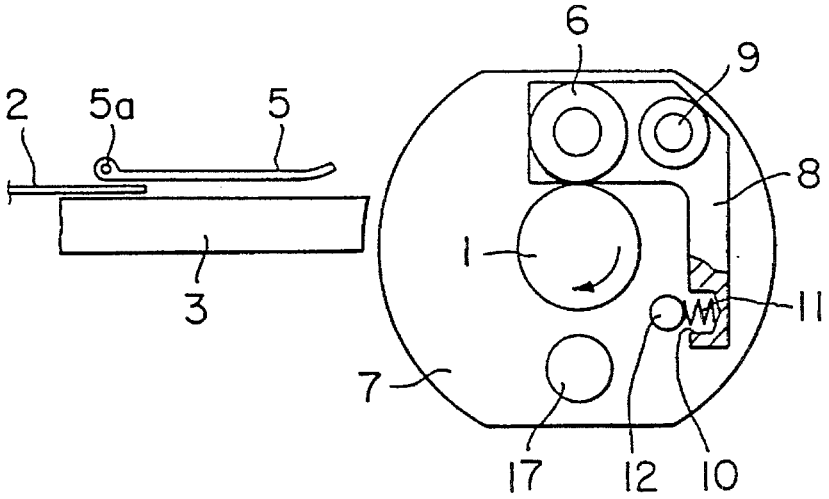
FIG. 3 shows the positions of the press roller and the rotation roller at start of operation of the separating apparatus for punched sheet according to the present invention.
Figure 5:
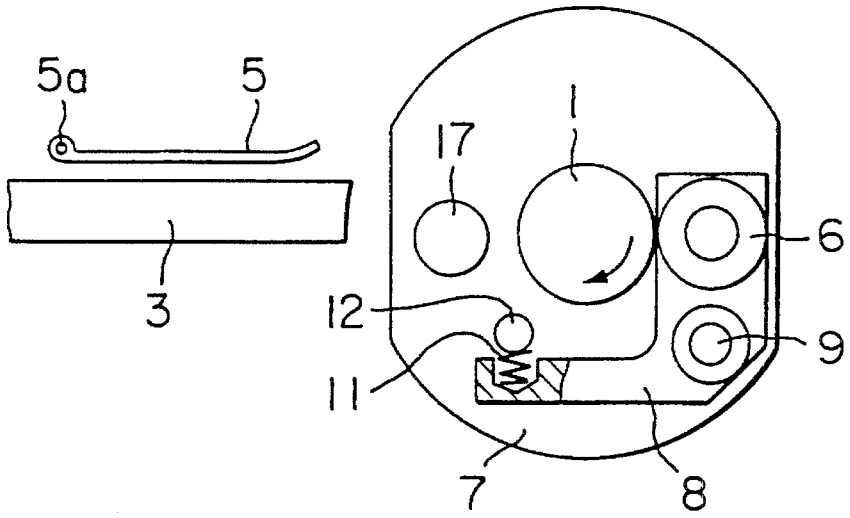
FIG. 5 shows a final position of the pres roller relative to the feed roller.
Figure 5A:
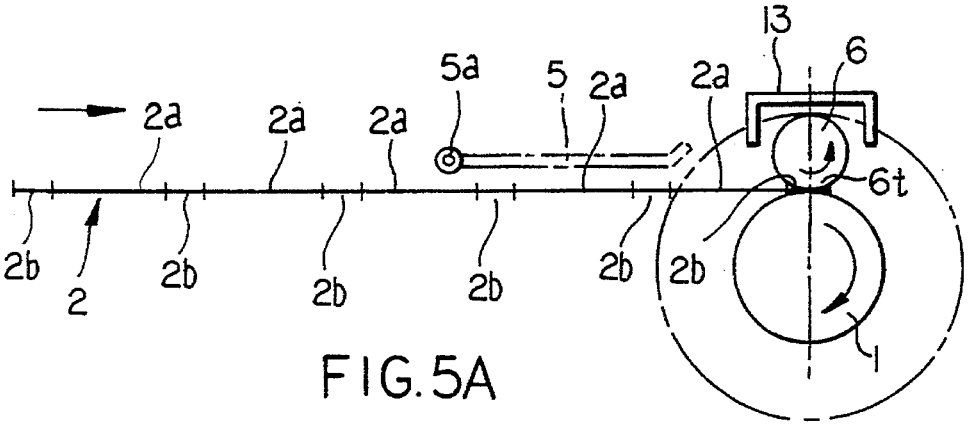
FIGS. 5A, 5B, 5C and 5D show successive positions of the press roller relative to the feed roller.
Figure 5B:
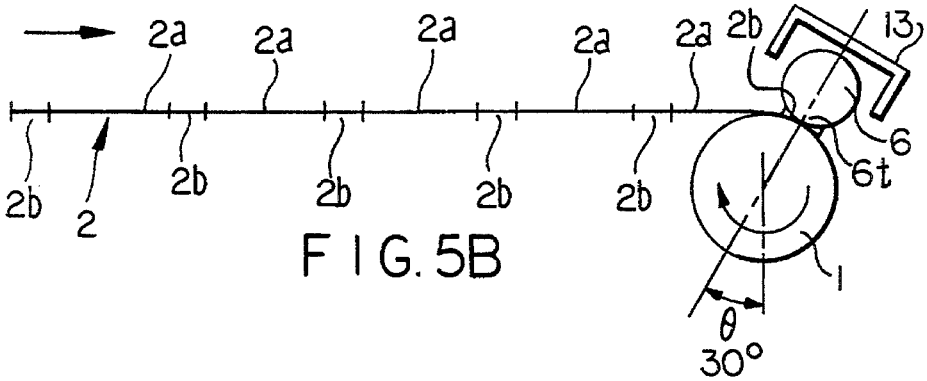
Figure 5C:
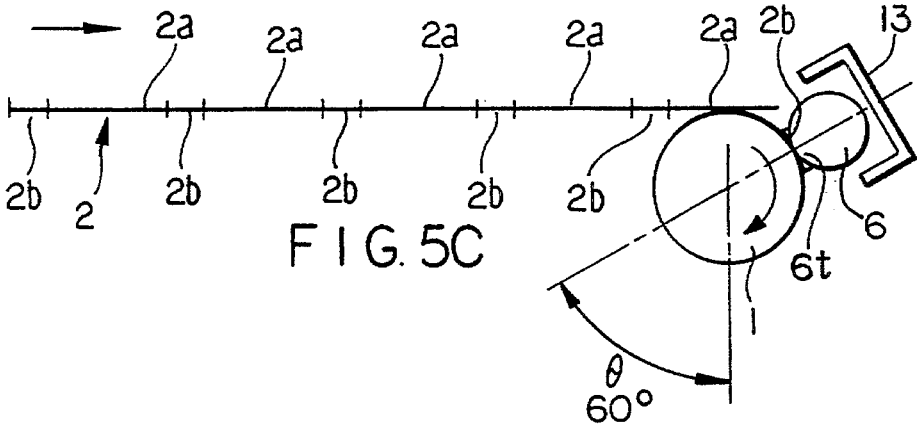
Figure 5D:
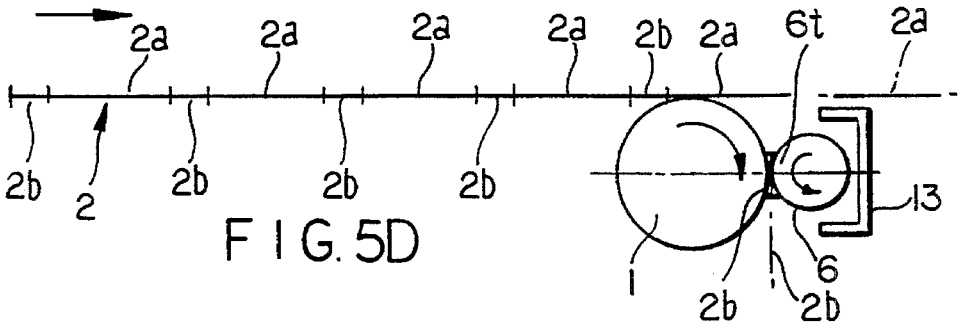

A press roller 6 is disposed above the rotation roller 1. Metal powder such as tungsten powder is also deposited over the circumferential surface of the press roller 6 in the same manner as on the rotation roller 1. The rotation roller 1 and the press roller 6 are operationally connected to each other by gear units 21, 22 to rotate at the same surface speed. In this case, it is preferable to provide a balancer 17 with the same weight as that of the press roller 6 at a symmetric position with the press roller 6. The press roller 6 is journaled through a pair of supports 8, each of which is provided on a rotation support plate 7 supported on the same axis as the axis of the rotation roller 1 on the side of the press roller 6, as shown in FIG. 2 and FIG. 3. Each support 8 is of L shape and is rotatably supported on the rotation support plate 7 through a pin 9 at the middle position thereof. Each support 8 has a bearing portion formed for the press roller 6 at one end thereof and a recess 10 formed at the other end. A coil spring 11 is set in the recess 10 so that an end of the coil spring 11 elastically contacts a stop 12 disposed adjacent to the pair of supports 8 to urge the supports 8 counterclockwise about the pin 9. Then the press roller 6 journaled on the supports 8 is constantly urged into contact with the rotation roller 1. FIG. 1A shows punched sheet 2 with cuts 2*c* defining press-off portions 2*a* and scrap portion 2*b*. A guide 13 is provided on the outer surface of rotation support plate 7. When the punched sheet 2 fed between the press roller 6 and the rotation roller 1 is moved with the press roller 6 rotating by 90 degrees along the circumferential surface of the rotation roller 1, the guide 13 is located to extend in the horizontal direction above the press roller 6 to transport in the horizontal direction a press-off portion 2*a* surrounded by cuts 2*c* after separation from the punched sheet 2. This will become evident when considering FIGS. 5A–5B showing the positions of the press roller 6 and the guide 13 relative to the rotation roller 1 during rotation of the roller 6 on the roller 1. Since a remaining scrap portion 2*b* in the punched sheet 2 is pinched between the rotation roller 1 and the press roller 6, it drops down below the rotation roller 1 with rotation of the rotation roller 1 and the press roller 6.

A gear 14 is mounted on the outer surface of one of the rotation support plates 7. The gear 14 is connected to an actuator (drive motor) 20 through a timing belt 24 so that the rotation support plates 7 are rotated by the drive motor 20 at the same speed as the feed speed of the punched sheet 2. Namely, the drive motor 20 is controlled by a controller 15 so that when the punched sheet 2 is pinched between the press roller 6 and the rotation roller 1 the drive motor 20 starts operating, and after the rotation support plates 7 are rotated by 90 degrees at the same speed as the feed speed of the punched sheet 2 the drive motor 20 stops, and when the separation of a punched sheet 2 is completed the motor again starts rotating to return the press roller 6 to the initial position. A sensor unit 16 for sending a detection signal to the controller 15 is disposed at a position spaced by distance L from a nip point n between the press roller 6 and the rotation roller 1. The sensor unit 16 detects the position of the tip end of the punched sheet 2 to be fed between the press roller 6 and the rotation roller 1. When the controller 15 receives the detection signal from the sensor unit 16, it calculates the time necessary for the punched sheet 2 to travel from the sensor unit 16 to the nip between the press roller 6 and the rotation roller 1, based on the detection signal from the sensor unit 16, the speed of punched sheet 2 and the distance L, and a control signal generated from the controller 15 actuates the drive motor 20 when the punched sheet 2 is pinched between the press roller 6 and the rotation roller 1. The drive motor 20 rotates the press roller 6 mounted on the rotation support plates 7 by 90 degrees at the same speed as the feed speed of the punched sheet 2 along the circumferential surface of the rotation roller 1. A timer unit may be built in the sensor unit 16.

The operation is next described.

Figure 4:
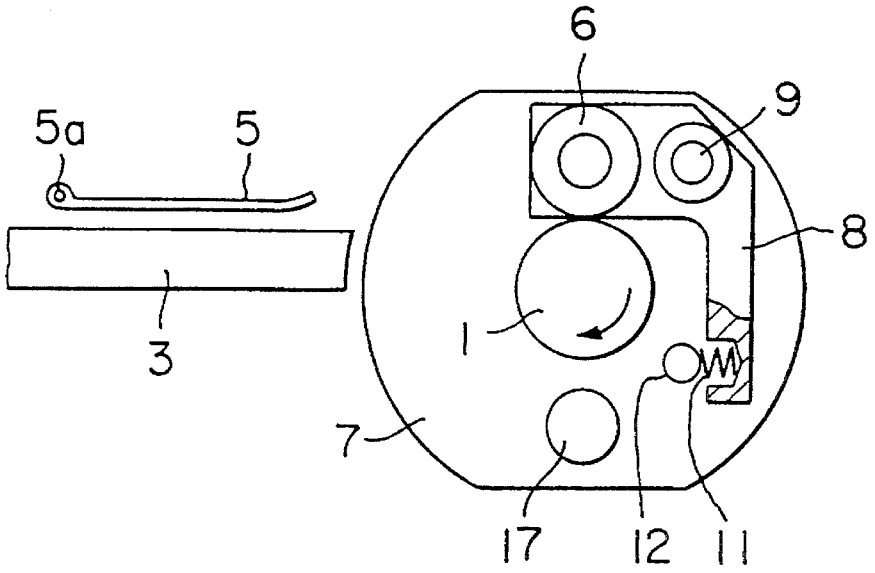
FIG. 4 shows an initial position of the press roller relative to a feed roller.

To separate the press-off portion(s) 2*a* surrounded by cuts 2*c* from the punched sheet 2, the punched sheet is transported through the transfer roller 4 and the press plate 5 toward the rotation roller 1 on the feed table 3. At the operation start the press roller 6 is located immediately above the rotation roller 1, as shown in FIG. 4, and the press roller 6 journaled on the supports 8 is urged against the rotation roller 1 by the coil spring 11.

When the punched sheet 2 is transported between the transfer roller 4 and the press plate 5 toward the rotation roller i on the feed table 3, the position of the tip end of the punched sheet 2 is detected by the sensor unit 16 disposed between the feed table 3 and the rotation roller 1 (on the upstream side of the rotation roller 1) and a detection signal from the sensor unit 16 is sent to the controller 15. The controller 15 calculates the time necessary for the tip end of the punched sheet 2 to travel from the sensor unit 16 to the position where the tip end is pinched between the press roller 6 and the rotation roller 1, and generates a control signal to the actuator (drive motor) 20 after the calculated time elapsed.

As the punched sheet 2 moving on the feed table 3 further advances, the tip end of punched sheet 2 reaches the nip point n between the press roller 6 and the rotation roller 1 and then is pinched between the press roller 6 and the rotation roller 1. The portion of punched sheet 2 pinched between the press roller 6 and the rotation roller 1 is the scrap portion 2*b*, which is the frame portion (scrap portion 2*b*) of punched sheet 2. The press roller 6 journaled on the supports 8 moves away from the rotation roller 1 against the force of coil spring 11 depending upon the thickness of the scrap portion 2*b*, whereby the scrap portion 2*b* is positively pinched between the press roller 6 and the rotation roller 1.

The controller 15 generates a control signal to the actuator 20 at the same time as the frame portion 2*b* of punched sheet fed to the rotation roller 1 is pinched between the press roller 6 and the rotation roller 1. With the control signal the actuator 20 actuates the rotation support plates 7 to rotate at the same speed as the feed speed of punched sheet 2 by 90 degrees from the separation start position to the separation end position. Since the supports 8 mounted on the rotation support plate 7 are also rotated similarly, the press roller 6 rotates 90 degrees along the circumferential surface of rotation-roller 1 in the same manner (FIG. 5). This moves the frame portion 2*b* of punched sheet 2 pinched between the press roller 6 and the rotation roller 1 downward with the press roller 6. As the frame portion 2*b* of punched sheet 2 is transferred downward, the punched sheet 2 is bent along the circumferential surface of the rotation roller 1, and due to stiffness of the sheet 2 causes separation at the cut-outs 2*c* which separates the press-off portion 2*a* from the punched sheet 2. The thus separated press-off portion 2*a* is transferred by the rotational force of the rotation roller 1 in the horizontal direction and then is stored in a container for sorting and arrangement.

When the sensor unit 16 detects the rear end of punched sheet 2, a detection signal is sent to the controller 15. With the detection signal the separation end is judged for the press-off portion 2*a* from first punched sheet 2. Then the actuator 20 actuates the rotation support plates 7 to rotate to return to the initial position. A second punched sheet 2 will be processed in the same manner as the above procedure.

Figure 6:
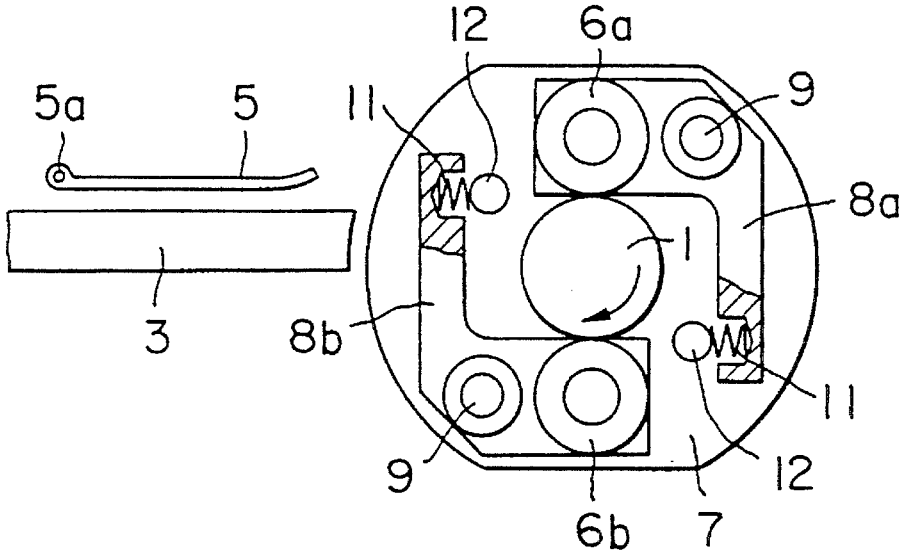
FIG. 6 shows an initial position of press rollers relative to a feed roller in another embodiment of separating apparatus for punched sheet according to the present invention.
Figure 7:
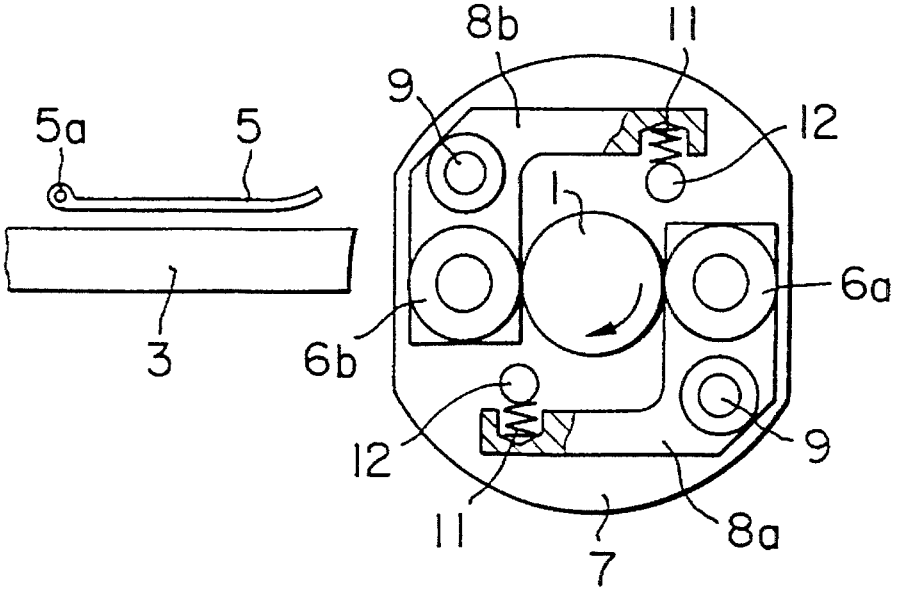
FIG. 7 shows a final position of the press rollers relative to the feed roller.
Figure 8:
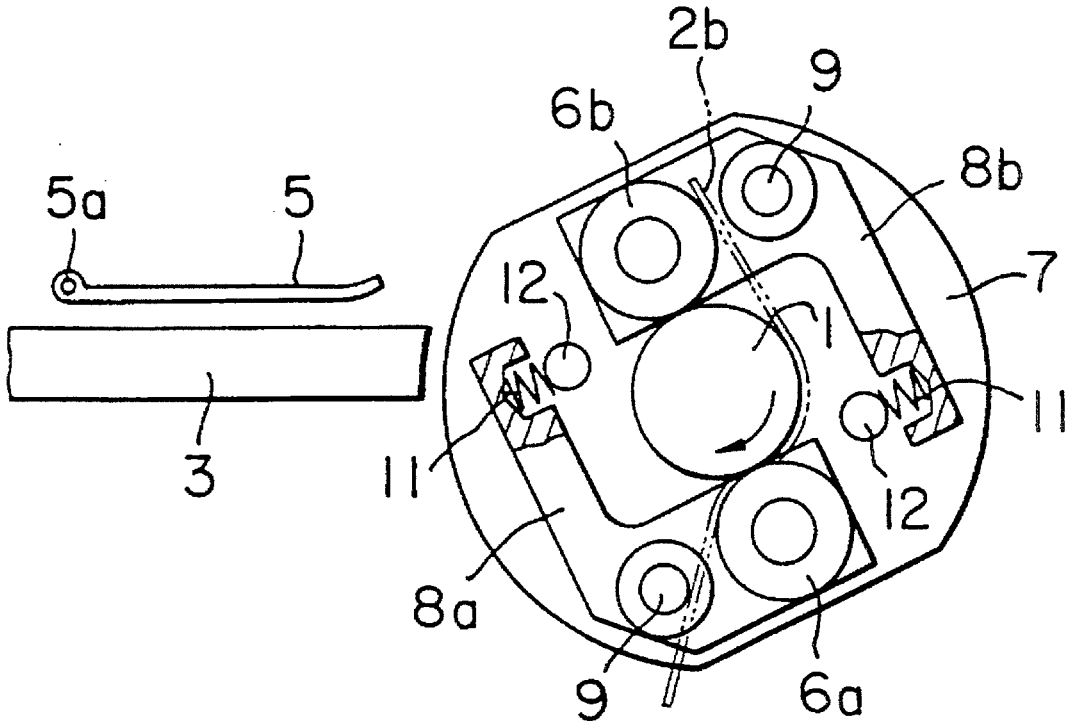
FIG. 8 shows a halfway position of the press roller returning to the initial position with respect to the feed roller.

FIG. 6 to FIG. 8 show another embodiment of the present invention, in which a pair of supports 8*a*, 8*b* are arranged in each rotation support plate 7. The pair of supports 8*a*, 8*b* have the same structure as that of the above support 8, and press roller 6*a* or 6*b* is arranged on one end of each support. The pair of supports 8*a*, 8*b* are journaled on each rotation support plate 7 by pins 9 positioned on the extension line of the diameter passing through the center of the rotation roller 1. The press rollers 6*a*, 6*b* are located on the extension line of the diameter passing through the center of the rotation roller 1. In other words, at the operation start one press roller is located immediately above the rotation roller 1, and the other press roller 6*b* is located immediately below the rotation roller 1. The sensor unit 16 provided on the upstream side of the rotation roller 1 is set to detect the tip end position of the punched sheet 2 fed between the press roller 6*a* and the rotation roller 1 and the position of the rear end of the scrap portion 2*b* of the punched sheet 2. When the controller 15 receives a detection signal from the sensor unit 16, it generates a control signal to the actuator 20. With the control signal the actuator 20 actuates the rotation support plates 7 to rotate 90 degrees around the rotation roller 1. Since two press rollers are arranged at angular intervals of 180 degrees, two rotation actions locate either one of the press rollers 6*a*, 6*b* at the initial position.

Then, when the tip end of the punched sheet 2 is pinched between one press roller 6*a* and the rotation roller 1, with a control signal, which is generated from the controller 15 receiving a signal from the sensor unit 16 which detected the tip end of punched sheet 2, the actuator 20 actuates the rotation support plates 7 to move 90 degrees from the separation start position as shown in FIG. 6 to the separation end position at the same speed as the speed of the punched sheet 2 along the circumferential surface of the rotation roller (FIG. 7). This also moves the pair of press rollers 6*a*, 6*b* by 90 degrees along the circumferential surface of the rotation roller 1, so that the frame portion 2*b* of the punched sheet 2 pinched between the press roller 6*a* and the rotation roller 1 is transferred downward with the rotation roller 6*a*. When the frame portion 2*b* of the punched sheet 2 is transferred downward, the punched sheet 2 is bent along the circumferential surface of rotation roller 1 so as to separate the press-off portion 2*a* from the punched sheet 2. The thus separated press-off portion 2*a* is transported by the rotational force of the rotation roller 1 in the horizontal direction and then is stored in a container for sorting and arrangement. The scrap portion 2*b* of punched sheet drops down below the rotation roller 1.

When the sensor unit 16 detects the rear end of the scrap portion 2*b* of punched sheet 2, with a control signal generated from the controller 15 which received a signal from the sensor unit 16, the actuator 20 actuates the rotation support plates 7 to further move by 90 degrees at the same speed as that of punched sheet 2 along the circumferential surface of the rotation roller 1. Since the pair of press rollers 6*a*, 6*b* provided on the rotation support plates 7 are also moved by 90 degrees along the circumferential surface of rotation roller 1, the other press roller 6*b* comes to be located at the initial separation start position with respect to the rotation roller 1. Even if the scrap portion 2*b* of the punched sheet 2 is long enough for the rear end of the scrap portion 2*b* to bridge between the feed table 3 and the rotation roller 1 during rotation of the press roller 6*b* (FIG. 8), which is a condition in which the scrap portion 2*b* of punched sheet 2 cannot be fed out by the rotation roller, the other press roller 6*b* flips the rear end of the scrap portion 2*b* (bridging portion) of punched sheet 2 upward by the rotational motion returning to the initial position relative to the rotation roller 1. Then the press plate 5 moves upward about the pin 5*a*, which prevents the rotation roller 1 from skidding on the scrap portion of punched sheet 2. Therefore, the scarp portion 2*b* of the punched sheet 2 positively drops down below the rotation roller 1. Also, since the pair of press rollers 6*a*, 6*b* are rotated in the same direction relative to the rotation roller 1, high-speed operation of the apparatus can be made possible.

As described above, the separating apparatus according to the present invention is so arranged that the press roller is moved along the circumferential surface of the feed roller to separate the portion surrounded by cuts from the punched sheet, so that the press-off portions can be automatically and positively separated from the punched sheet taken out of the puncher, regardless of the size, the shape and the location of the press-off portions in the punched sheet. Also, if the separating apparatus is so arranged that the press rollers are arranged at angular intervals of 180 degrees relative to the feed roller and the press rollers are rotated while detecting the tip end position of the punched sheet fed between a press roller and the feed roller and the rear end scrap portion of the punched sheet, during rotation of the press rollers the rear end scrap portion of the punched sheet can be flipped upward, which ensures the drop of the scrap portion of the punched sheet down below the roller. Further, rotating the pair of press rollers in the same direction relative to the feed roller enables the high-speed operation.

Second Embodiment

The second embodiment of the present invention will be described in detail with reference to the drawings.

Figure 9:
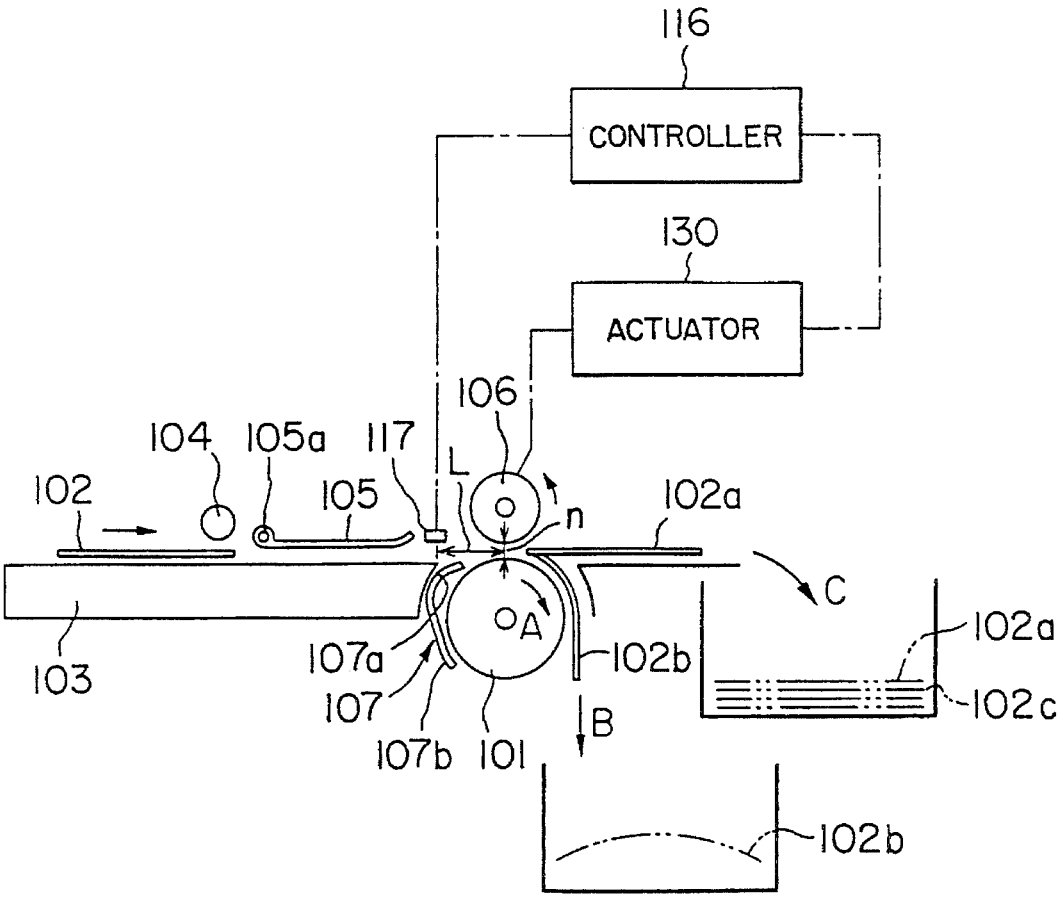
FIG. 9 is a schematic drawing to show a second embodiment of separating apparatus for punched sheet according to the present invention.

FIG. 9 is a schematic drawing to show a separating apparatus for a punched sheet according to the present invention. In the separating apparatus for a punched sheet a rotation roller (feed roller) 101 is rotatably supported on a main body (not shown) of the apparatus and is connected for example to an inverter motor 125 to be always rotated in the direction of arrow A. Metal powder such as tungsten powder is deposited over the circumferential surface of the rotation roller 101 to increase the frictional force, whereby a punched sheet 102 fed thereto is positively fed out. Also, a transfer roller 104 and a press plate 105 are disposed above a feed table 103 located on the upstream side of the rotation roller 101 in the feed direction of punched sheet 102, so that the punched sheet 102 to be processed may be transported between the transfer roller 104 and the feed table 103 and then toward the rotation roller 101 along the feed table 103 while being pressed by the press plate 105. The press plate 105 is supported by a pin 105*a* on the upstream side in the feed direction so as to be vertically rockable.

Figure 14:
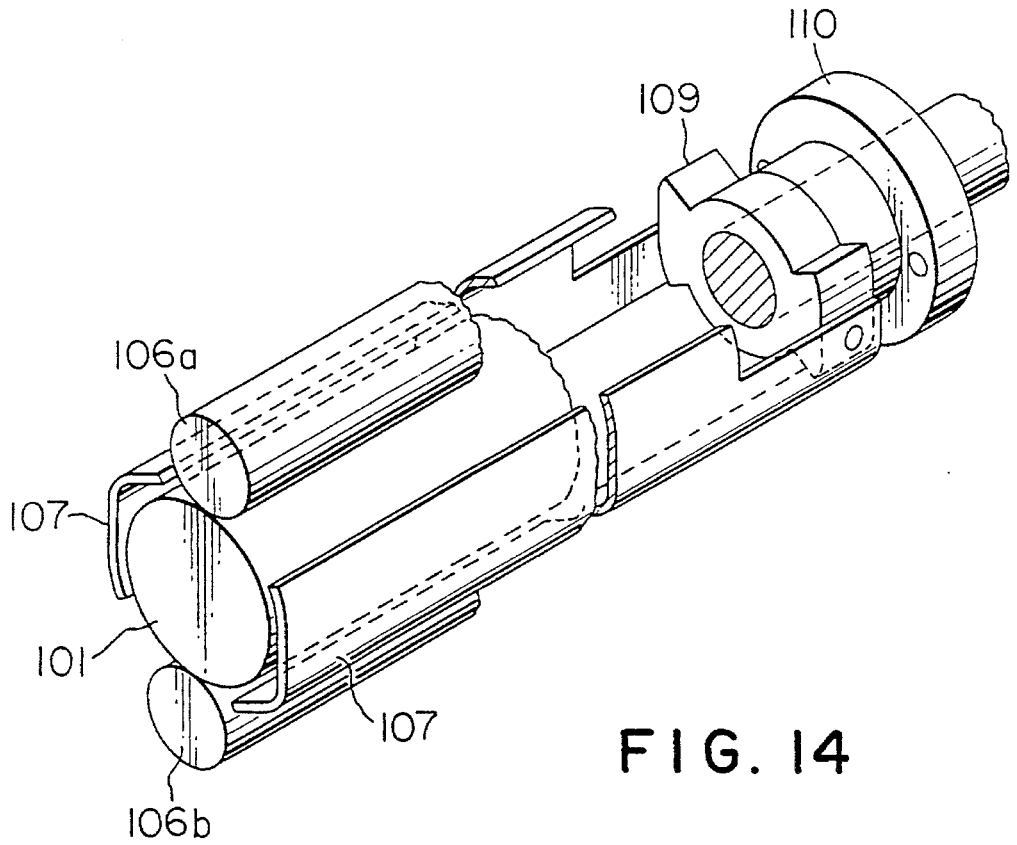
FIG. 14 is a drawing to show a third embodiment of the separating apparatus for punched sheet according to the present invention.

A press roller 106 is disposed above the rotation roller 101. Metal powder such as tungsten powder may be deposited on the circumferential surface of the press roller 106 to increase the frictional force. Also, a separation helping plate 107 is arranged adjacent to the rotation roller 101 before the press roller 106, that is, on the upstream side in the feed direction of the punched sheet 102. The separation helping plate 107 helps the separation of a portion 102*a* surrounded by cuts 102*c* from the punched sheet 102 in cooperation with the press roller 106. As shown in FIG. 14, the separation helping plate 107 is composed of an arcuate portion 107*a* and a plane portion 107*b* to cover about one third of the circumference of the rotation roller 101. The separation helping plate 107 is arranged so that when the press roller 106 is located above the rotation roller 101, the tip end of the arcuate portion 107*a* is below the end face of the feed table 103 and when the helping plate 107 rotates by about 90 degrees around the rotation roller 101 together with the press roller 106, the plane portion 107*b* becomes horizontal. The rotation roller 101 and the press roller 106 are operationally connected to each other through gears 108*a*, 108*b* to rotate at the same surface speed, as shown in FIG. 10.

Figure 10:
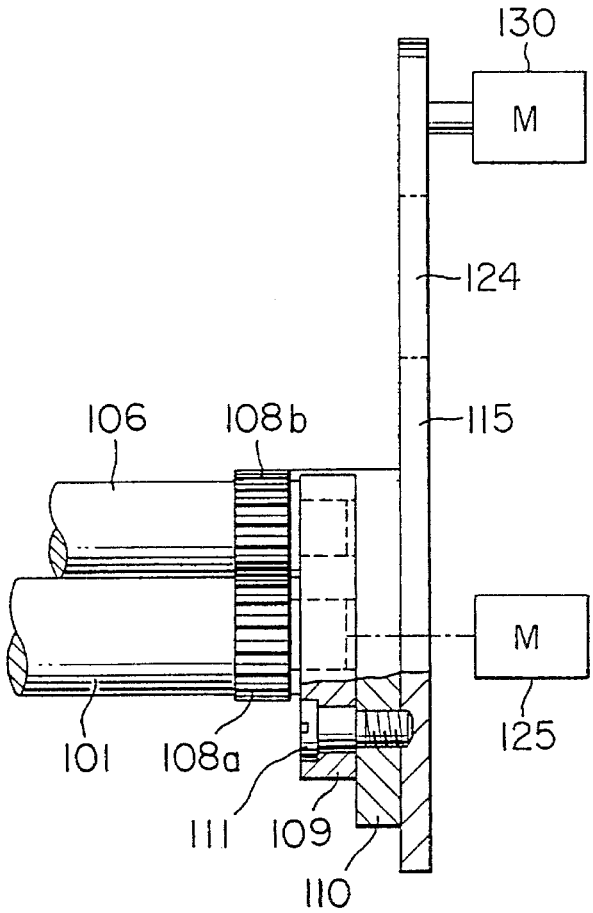
FIG. 10 is an end view showing the main part of the second embodiment of the separating apparatus for punched sheet according to the present invention.
Figure 11:
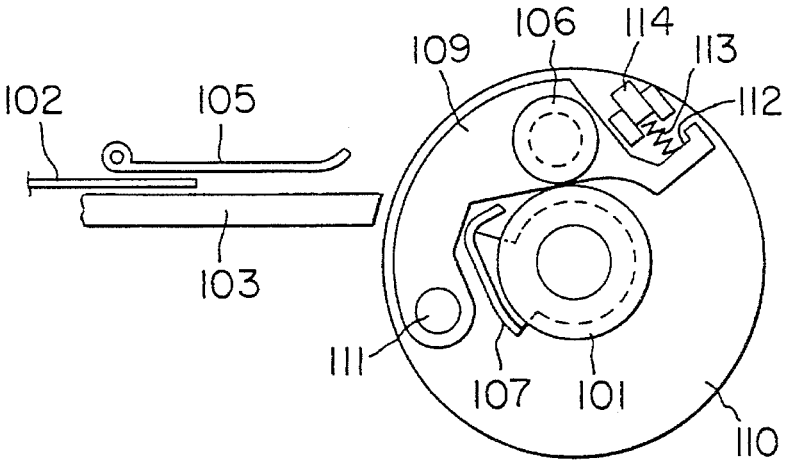
FIG. 11 is a drawing to show positions of press roller and rotation roller before the start of operation of the second embodiment of the separating apparatus for punched sheet according to the present invention.

The press roller 106 is journaled at the middle position of a pair of supports 109 provided on both sides of the press roller 106 and having an overall curved shape, as shown in FIG. 10 and FIG. 11. One end of each support 109 is journaled by a pin 111 on a rotation support plate 110 supported coaxially with the rotation roller 101. There is a recess 112 formed in the other end of each support 109, and a coil spring 113 is set in the recess 112. The upper end of the coil spring 113 elastically contacts a stop portion 114 disposed adjacent to each support 109 to constantly push the press roller 106 journaled on the pin 111 on the support 109 against the rotation roller 101. Also, the separation helping plate 107 is fixed to the rotation support plates 110 by appropriate fixing means. The separation helping plate 107 is arranged to guide the punched sheet 102 fed between the press roller 106 and the rotation roller 101, and when the press roller 106 is rotated by a certain angle, for example 90 degrees, along the circumferential surface of the rotation roller 101, the plane portion 107*b* is horizontally located above the rotation roller 101, whereby the press-off portion 102*a* surrounded by cuts 102*c* is fed out in the horizontal direction after being separated from the punched sheet 102. Since the remaining scrap portion 102*b* in the punched sheet 102 is pinched between the rotation roller 101 and the press roller 106, it drops down below the rotation roller 101 by the rotation of the rotation roller 101 and the press roller 106. It is preferable in this case that a balancer having the same weight as that of the press roller 106 be placed at a position which is symmetrical with the press roller 106 on a line connecting the center of press roller 106 and the center of the rotation support plate 110.

Further, a gear 115 is attached to the outer surface of one of the rotation support plate 110. The gear 115 is connected to an actuator (drive motor) 130 through a timing belt 124 or gear so that the drive motor 130 rotates the rotation support plates 110 at the same speed as the feed speed of the punched sheet 102. In other words, a controller 116 controls the drive motor 130 so that when the punched sheet 102 is pinched between the press roller 106 and the rotation roller 101 the motor 130 starts rotating the rotation support plate 110 at the same speed as the feed speed of the punched sheet 102 by a certain angle, for example 90 degrees and then stops, and after completion of separation of the punched sheet 102 the motor is again actuated to return the press roller 106 to the initial position. A sensor unit 117 for sending a detection signal to the controller 116 is arranged at a position spaced by distance L from a nip point n between the press roller 106 and the rotation roller 101. The sensor unit 117 detects the position of the tip end of the punched sheet 102 fed between the press roller 106 and the rotation roller 101. The controller 116 receiving the detection signal from the sensor unit 117 calculates the time necessary for the punched sheet 102 to travel from the sensor unit 117 to the nip point between the press roller 106 and the rotation roller 101 based on the detection signal from the sensor unit 117, the speed of the punched sheet 102 and the distance L. The controller 116 generates a control signal to actuate the drive motor 130 when the punched sheet 102 is pinched between the press roller 106 and the rotation roller 101. The drive motor 130 rotates the press roller 106 and the separation helping plate 107 disposed on the rotation support plate 110 through a certain angle, for example 90 degrees along the circumferential surface of the rotation roller 101 at the same speed as the feed speed of punched sheet 102. The sensor unit 117 may include a timer device. A rotary encoder may be provided on the shaft of the rotation roller 101 so that the rotation roller 101 may be returned to the initial position with the rotary encoder.

The operation is next described.

At a stage before the operation start the press roller 106 is located about 10 degrees in the rotation direction of rotation roller 101 behind the vertical line passing through the rotation center of the rotation roller 101, as shown in FIG. 11. At this stage the press roller 106 is urged against the rotation roller 101 by the coil spring 113. Also at the position shown in FIG. 11, the press roller 106 is additionally urged against the rotation roller 101 by its weight, because the support 109 supporting the shaft of the rotation roller 106 rotates about the pin 111 located beside the rotation roller 101.

When the punched sheet 102 is transported through the transfer roller 104 and the press plate 105 toward the rotation roller 101 on the feed table 103 to carry out the separation of punched sheet 102, the tip end position of the punched sheet 102 is detected by the sensor unit 117 disposed between the feed table 103 and the rotation roller 101 (on the upstream side of the rotation roller 101). When a detection signal from the sensor unit 117 is sent to the controller 116, the controller 116 calculates the time necessary for the tip end of the punched sheet 102 to travel from the sensor unit 117 to the nip point between the press roller 106 and the rotation roller 101, and generates a control signal to the actuator 130 after the calculated time elapsed.

As the punched sheet 102 moving on the feed table 103 further advances, the tip end of the punched sheet 102 reaches the nip point n between the press roller 106 and the rotation roller 101. Then the tip end of the punched sheet 102 is pinched between the press roller 106 and the rotation roller 101. The pinched portion of punched sheet 102 between the press roller 106 and the rotation roller 101 is a scrap portion 102*b*, which is a frame portion in the punched sheet 102. The press roller 106 journaled on the supports 109 moves away from the rotation roller 101 against the force of coil springs 113 depending upon the thickness of the scarp portion 102*b*, whereby the scrap portion 102*b* is positively pinched between the press roller 106 and the rotation roller 101.

When the frame portion 102*b* of punched sheet 102 fed to the rotation roller 101 is pinched between the press roller 106 and the rotation roller 101, with the control signal generated from the controller 116 the actuator (drive motor) 130 simultaneously starts rotating the rotation support plate 110 at the same speed as the feed speed of the punched sheet 102 from the separation start position to the separation end position. Since the supports 109 and the separation helping plates 107 are fixed to the rotation support plates 110, the press roller 106 supported on the support 109 and the separation helping plate 107 rotate along the circumferential surface of rotation roller 101.

Figure 12:
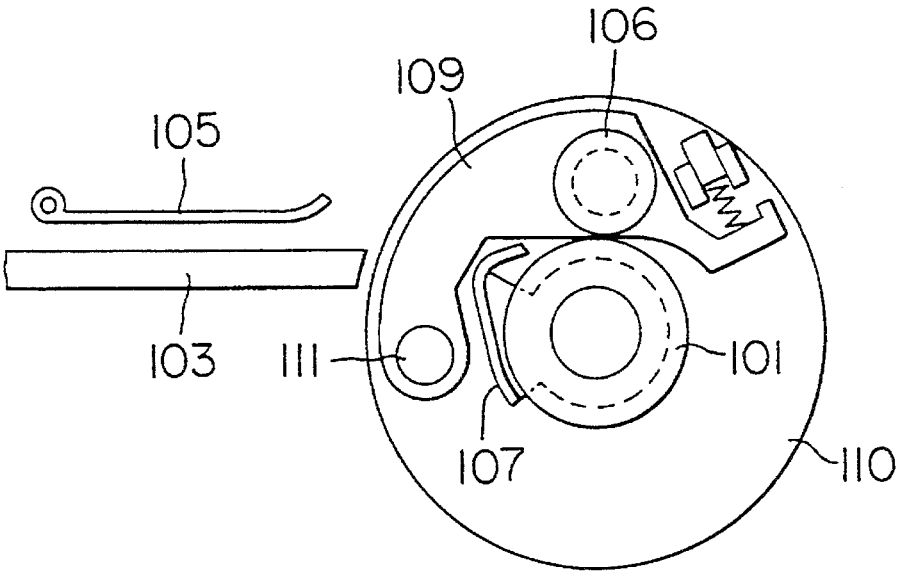
FIG. 12 shows an initial position of the press roller relative to the feed roller of the second embodiment.

FIG. 12 shows the stage at which the press roller 106 and the separation helping plate 107 start rotating along the circumferential surface of rotation roller 101. At this stage the press roller 106 is located immediately above the rotation roller 101. At this stage the punched sheet 102, the tip end of which is pinched between the press roller 106 and the rotation roller 101, is also supported by the tip end portion of separation helping plate 107.

Figure 13:
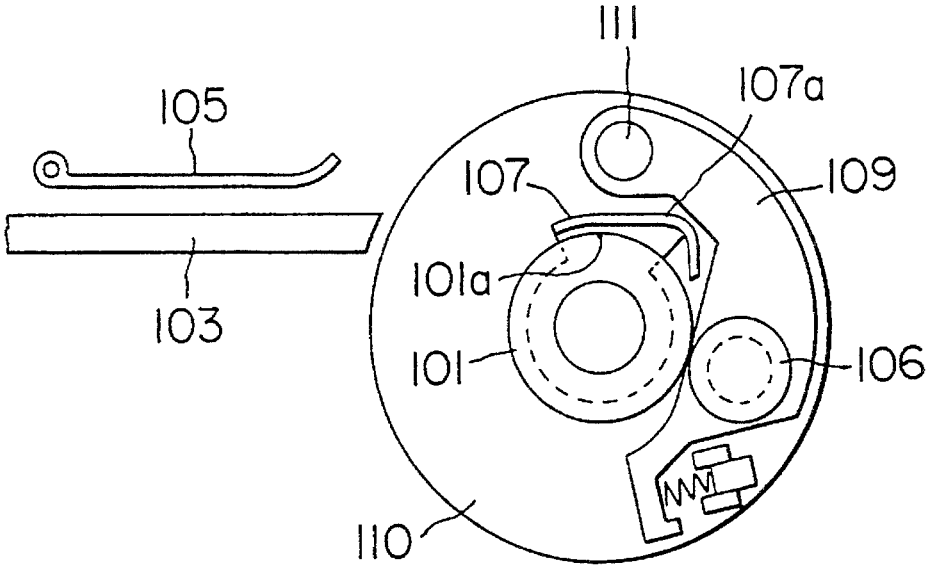
FIG. 13 shows a final position of the press roller relative to the feed roller of the second embodiment.

FIG. 13 shows the separation end state after the press roller 106 and the separation helping plate 107 rotated not less than 100 degrees, preferably about 115 degrees from the initial stage along the circumferential surface of the rotation roller 101. In this state the arcuate portion 107*a* of separation helping plate 107 is located ahead of the vertical line passing through the rotation center of rotation roller 101. Thus a distance between the arcuate portion 107*a* located after the second row in the punched sheet 102 and the nip point between the press roller 106 and the rotation roller 101 becomes shorter than the distance between the top end 101*a* of the rotation roller 101 and the nip point in the case in which the separation helping plate 107 is absent. This assures the separation of short press-off portions. Namely, since the separation after the second row in the punched sheet 102 starts from the arcuate portion 107*a* because of the separation helping plate 107, short portions can be more surely separated as compared with the arrangement in which the separation starts from the top end 101*a* of rotation roller 101.

While the press roller 106 and the separation helping plate 107 move from the state in FIG. 12 to the state in FIG. 13, the punched sheet 102 is bent along the circumferential surface of rotation roller 101, whereby the press-off portion 102*a* is separated. In this case, since the frame portion 102*b* of the punched sheet 102 is pinched between the press roller 106 and the rotation roller 101, it is transported down below the rotation roller 101 in the direction as shown by arrow B in FIG. 9. Since the plane portion 107*b* of separation helping plate 107 is located in the horizontal state as shown in FIG. 13, the press-off portion 102*a* separated from the punched sheet 102 is horizontally transported by a rotational force of the rotation roller 101 in the direction shown by arrow C in FIG. 9 from the separation helping plate 107, and is then stored in a container for sorting and arrangement.

When the sensor unit 117 detects the rear end portion of the press-off portion 102*a*, a detection signal is sent to the controller 116. Based on the detection signal, the separation end is judged for the press-off portion 102*a* from the first punched sheet 102. Then the actuator 130 starts operating to rotate the rotation-support plate 110 so as to return it to the initial position. Thus the press roller 106 and the separation helping plate 107 are located at the wait position shown in FIG. 11, and then a second punched sheet 102 is processed in the same manner as the above procedure. The press roller 106 is so arranged on the supports 109 that the weight of press roller 106 acts away from the rotation roller 101 during the return operation, which reduces the friction between the press roller 106 and the rotation roller 101.

Figure 15:
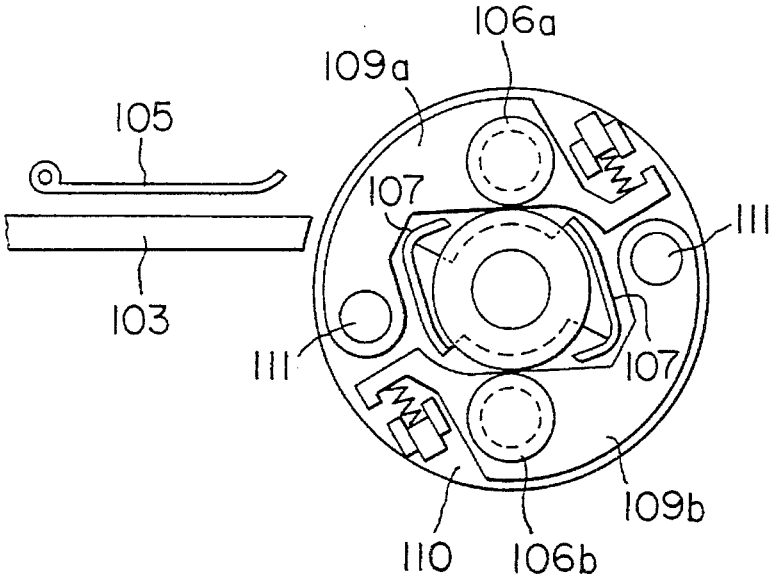
FIG. 15 is a drawing to show positions of press rollers and rotation roller at a stage before the start of operation of the separating apparatus for punched sheet shown in FIG. 14.
Figure 16:
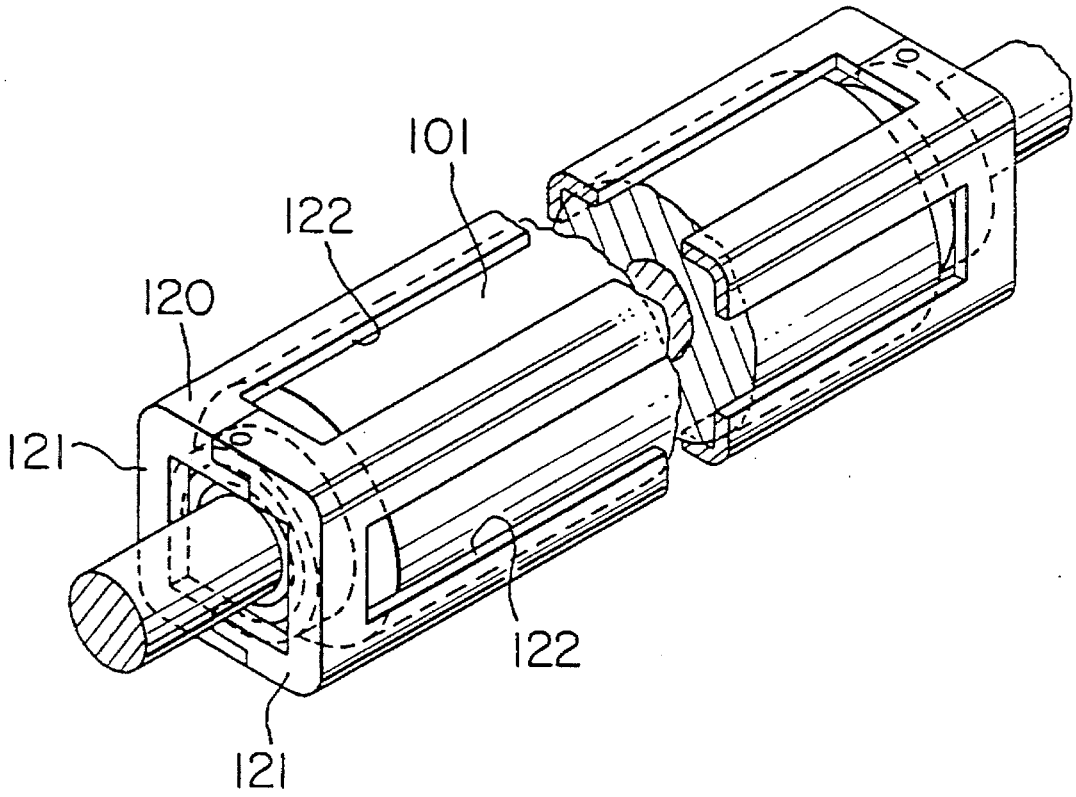
FIG. 16 is a drawing to show another embodiment of the separating apparatus for punched sheet according to the present invention.

FIG. 14 to FIG. 16 show further embodiments of the present invention. In the embodiment shown in FIG. 14 and FIG. 15, a pair of supports 109*a*, 109*b* are provided on each rotation support plate 110. The pair of supports 109*a*, 109*b* have the same structure as that of the above supports 109. A press roller 106*a* is arranged on the support 109*a*, and a press roller 106*b* on the support 109*b*. The pair of supports 109*a*, 109*b* are journaled by pins 111 on the extension line of the diameter passing through the center of rotation roller 101 on the rotation support plate 110, respectively. A separation helping plate 107 is provided for the press roller 106*a* on the support 109*a* and for the press roller 106*b* on the support 109*b*. The separation helping plates 107 have the same structure as that of the separation helping plate 107 shown in FIG. 11. Since the press rollers 106*a*, 106*b* are located on the extension line of the diameter passing through the center of the rotation roller 101, one of the pair of press rollers, for example, press roller 106*a* is located immediately above the rotation roller 101 or in the vicinity thereof, while the other press roller 106*b* is immediately below the rotation roller 101 or in the vicinity thereof, at the operation start. The press roller. 106*b* located immediately below the rotation roller 101 or in the vicinity thereof is at a rest position.

In the embodiment shown in FIG. 14 and FIG. 15, the sensor unit 117 provided on the upstream side of the rotation roller 101 detects the tip end position of the punched sheet 102 to be fed between the press roller 106*a* and the rotation roller 101. Also, the rear end position of the press-off portion 102*a* in the last row in the punched sheet is detected for example by a rotary encoder provided on the rotation roller 101. The actuator 130 starts operating by the control signal generated by the control unit 116 which received the detection signal from the sensor unit 117 or the rotary encoder, so that the rotation support plate 110 is rotated by 90 degrees for each operation around the rotation roller 101. This is because the two press rollers are located at an angular spacing of 180 degrees and either one of the press rollers is located at the initial position through two rotation actions.

In the embodiment shown in FIG. 16, a separation helping device 120 is arranged to surround the rotation roller 101.

The separation helping device 120 is composed of two half members 121, 121 substantially of U shape in cross section. The combination of the half members 121, 121 forms a square barrel with an opening portion 122 on each side. Using the separation helping device 120, only one of the opening portions is used for one press roller shown in FIG. 11, whereas two of the opening portions are used for two press rollers 106 shown in FIG. 14.

Figure 19:
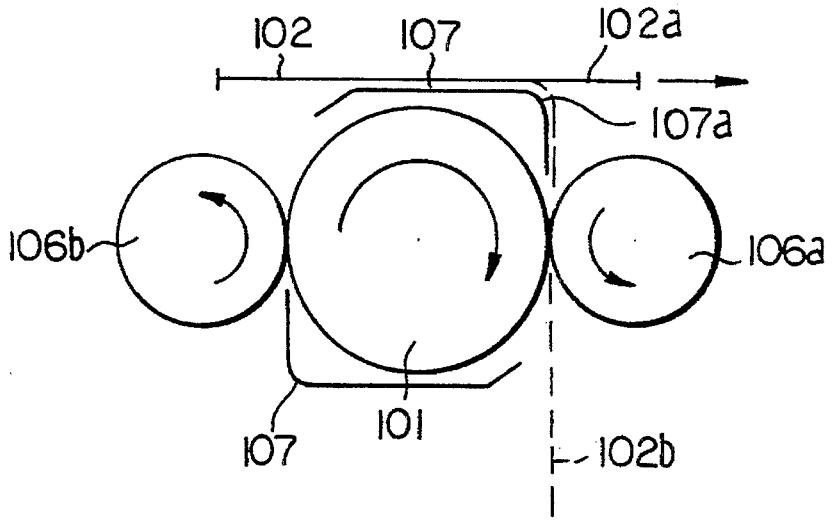
FIG. 19 diagrammatically illustrates the press rollers of FIG. 14 just before their final position to show cooperation with the punched sheet.
Figure 17:
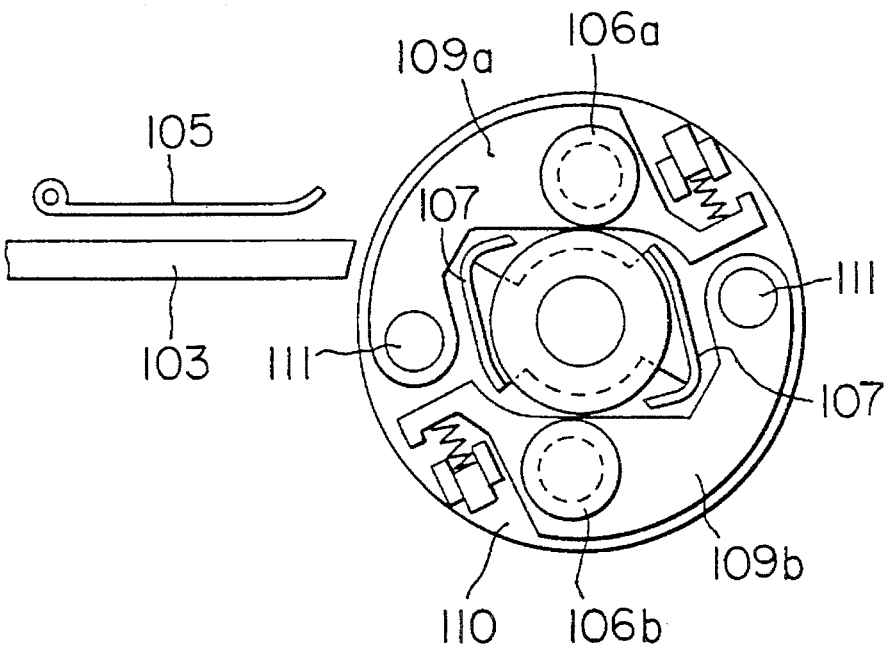
FIG. 17 is a drawing to show an initial position of the press rollers relative to the feed roller in the separating apparatus for punched sheet shown in FIG. 14.
Figure 18:
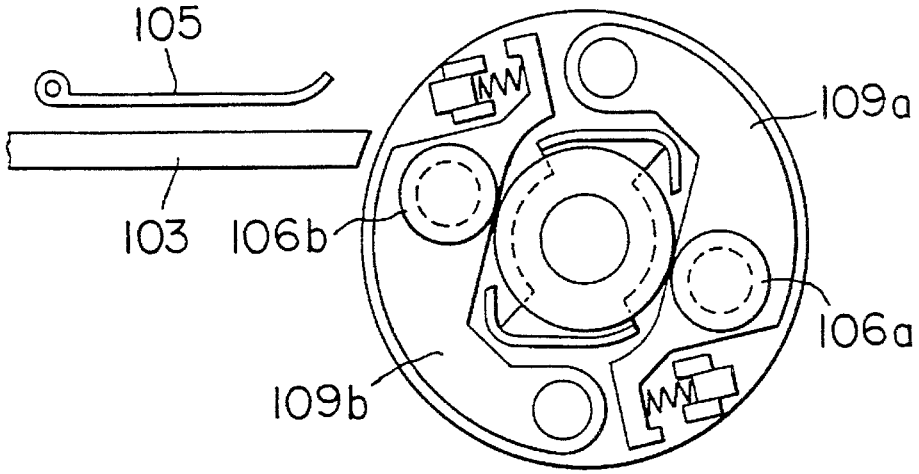
FIG. 18 is a drawing to show a final position of the press rollers relative to the feed roller in the separating apparatus for punched sheet shown in FIG. 14.

When the tip end portion of punched sheet 102 is pinched between one press roller 106*a* and the rotation roller 101, the actuator 130 is actuated by a control signal generated from the controller 116 which received the signal from the sensor unit 117 detecting the tip end position of punched sheet 102, so as to move the rotation support plate 110 at the same speed as the feed speed of punched sheet 102 along the circumferential surface of the rotation roller 101 by 90 degrees from the separation start position in FIG. 17 to the separation end position in FIG. 18. This moves the pair of press rollers 106*a*, 106*b* and the separation helping plates 107, 107 simultaneously along the circumferential surface of rotation roller 101, whereby the frame portion 102*b* of punched sheet 102 pinched between the press roller 106*a* and the rotation 101 is transported downward together with the press roller 106*a* as shown in FIG. 19. When the frame portion 102*b* of the punched sheet 102 is transported downward, the punched sheet 102 is bent along the circumferential surface of rotation roller 101, which separates the press-off portion(s) 102*a* from the punched sheet 102. The thus separated press-off portion 102*a* is horizontally transported by the rotational force of rotation roller 101 and the separation helping plate 107 and is then stored in a container for sorting and arrangement. On the other hand, the scrap portion 102*b* of punched sheet drops down below the rotation roller 101.

Then, when the sensor unit 117 detects the rear end position of the press-off portion 102*a* in the last row in the punched sheet 102, the actuator 130 is actuated by a control signal generated from the controller 116 receiving a signal from the sensor unit 117, as to further move the rotation support plate 111 at the same speed as that of the punched sheet 102, along the circumferential surface of rotation roller 110. The pair of press rollers 106*a*, 106*b* and the separating helping plates 107, 107 provided on the rotation support plate 110 are also moved simultaneously along the circumferential surface of rotation roller 101, whereby the other press roller 106*b* is located at the initial position relative to the rotation roller 101. Thus, the rear end side scrap portion of punched sheet 102 bridges between the feed stage 103 and the rotation roller 101. Then, even if the punched sheet is in the condition that it cannot be fed out by the rotation roller 101, the other press roller 106*b* rotates to the initial position relative to the rotation roller 101 to move the press plate 105 upward about the pin 105a thereby to flip the rear end scrap portion (bridging portion) of punched sheet 102 upward, whereby the scrap portion of punched sheet 102 positively drops down below the rotation roller 101 (see FIG. 8). As described above, high-speed operation of the apparatus can be made possible by rotating the pair of press rollers 106*a*, 106*b* in the same direction relative to the rotation roller 101.

According the present invention as described above, the press roller(s) and the separation helping plate(s) are moved along the circumferential surface of the feed roller to separate the portion(s) surrounded by cuts from the punched sheet, so that the press-off portion(s) may be automatically and positively separated from the punched sheet taken out of the puncher, regardless of the size, the shape and the location of press-off portion(s) in the punched sheet. If the press rollers are arranged at angular intervals of 180 degrees relative to the feed roller and rotated while detecting the tip end position of punched sheet fed into between a press roller and the feed roller and the rear end position of a press-off portion in the last row in the punched sheet, during rotation of the press rollers the rear end scrap portion of the punched sheet can be flipped upward, which assures the certain drop of the scrap portion of the punched sheet down below the roller. Further, the high-speed operation can be achieved by rotating a pair of press rollers in the same direction relative to the feed roller.

What is claimed is:

1. A separating apparatus for a punched sheet having a portion surrounded by cuts comprising:

a feed roller for feeding the punched sheet;

a press roller disposed above the feed roller to elastically pinch with the feed roller a tip portion of the punched sheet fed therebetween;

a connector for rotating the press roller and the feed roller at the same surface speed; and an actuator for actuating the press roller to move along a circumferential surface of the feed roller at the same speed as that of the punched sheet to separate the portion surrounded by the cuts from the punched sheet.

2. The separating apparatus according to claim 1, wherein the press roller is supported by a pair of supports, each being journaled by a respective pin on a rotation support plate disposed on a respective side of the feed roller.

3. The separating apparatus according to claim 2, comprising a coil spring at an end portion of each support to act between the support and the rotation support plate and to urge the press roller against the feed roller.

4. The separating apparatus according to claim 1, further comprising a sensor unit provided immediately before the feed roller, for detecting a position of a tip portion of the punched sheet and a controller for controlling the actuator, based on a signal from the sensor unit, to move the press roller.

5. The separating apparatus according to claim 4, wherein the controller controls the actuator so that, based on a detection signal of the tip portion of the punched sheet from the sensor unit, the actuator actuates the press roller to move from a separation start position to a separation end position and, based on a detection signal of a rear portion of the punched sheet from the sensor unit, the actuator actuates the press roller to move from the separation end position to the separation start position.

6. A separating apparatus for a punched sheet having a portion surrounded by cuts comprising:

a feed roller for feeding the punched sheet;

a rotation support plate disposed at one side of the feed roller;

a pair of separate press rollers journaled on the rotation support plate at an angular spacing of 180 degrees from each other;

a connector for rotating the press rollers and the feed roller at the same surface speed; and an actuator connected to the rotation support plate to rotate the rotation support plate such that the press rollers move along a circumferential surface of the feed roller at the same speed as that of the punched sheet.

7. The separating apparatus according to claim 6, wherein:

each press roller is supported by a pair of supports, each support being journaled by a pin on a respective one of two rotation support plates disposed on opposite sides of the feed roller.

8. The separating apparatus according to claim 7, comprising a coil spring at an end portion of each support to act between the support and the rotation support plate and to urge the press roller against the feed roller.

9. The separating apparatus according to claim 6, further comprising a sensor unit provided immediately before the feed roller, for detecting a position of a tip portion of the punched sheet and a controller for controlling the actuator, based on a signal from the sensor unit, to move the press roller.

10. The separating apparatus according to claim 9, wherein the controller controls the actuator so that, based on a detection signal of the tip portion of the punched sheet from the sensor unit, the actuator actuates one of the press rollers to move by 90 degrees from a separation start position and, based on a detection signal of a rear portion of the punched sheet from the sensor unit, the actuator actuates the other of the press rollers to move by 90 degrees to the separation start position.

11. A separating apparatus for a punched sheet having a portion surrounded by cuts comprising:

a feed roller for feeding the punched sheet; a press roller disposed above the feed roller to elastically pinch with the feed roller a tip portion of the punched sheet fed therebetween;

a connector for rotating the press roller and a feed roller at a same surface speed;

a separation helping device for helping separation of the portion surrounded by the cuts from the punched sheet in cooperation with the press roller; and an actuator for actuating the press roller and the separation helping device to move along a circumferential surface of a feed roller at a same speed as that of the punched sheet to separate the portion surrounded by the cuts from the punched sheet.

12. The separating apparatus according to claim 11, wherein the press roller is supported by a pair of supports, each support being journaled by a pin on a respective rotation support plate disposed on a respective side of the feed roller.

13. The separating apparatus according to claim 12, comprising a coil spring at an end portion of each support to act between the support and the rotation support plate and to urge the press roller against the feed roller.

14. The separating apparatus according to claim 11, further comprising a sensor unit provided immediately before the feed roller, for detecting a position of a tip portion of the punched sheet and a controller for controlling the actuator, based on a signal from the sensor unit, to move the press roller and the separation helping device.

15. The separating apparatus according to claim 14, wherein the controller controls the actuator so that, based on a detection signal of the tip portion of the punched sheet from the sensor unit, the actuator actuates the press roller and the separation helping device to move from a separations start position to a separation end position and, based on a detection signal of a rear portion of the punched sheet from the sensor unit, the actuator actuates the press roller and the separation helping device to move from the separation end position to the separation start position.

16. A separating apparatus for a punched sheet having a portion surrounded by cuts comprising:

a feed roller for feeding the punched sheet;

a rotation support plate disposed at one side of the feed roller;

a pair of separate press rollers journaled on the rotation support plate at an angular spacing of 180 degrees from each other;

a connector for rotating the press rollers and the feed roller at the same surface speed;

a pair of separation helping devices supported on the rotation support plate at an angular spacing of 180 degrees to help in separation of the portion surrounded by the cuts from the punched sheet in cooperation with the press rollers; and an actuator connected to the rotation support plate to rotate the rotation support plate so as to move the pair of press rollers and the pair of separation helping devices along a circumferential surface of the feed roller at the same speed as that of the punched sheet.

17. The separating apparatus according to claim 16, wherein each press roller is supported by a pair of supports, each support being journaled by a pin on a respective one of two said rotation support plates disposed on opposite sides of the feed roller.

18. The separating apparatus according to claim 17, comprising a coil spring at an end portion of each support to act between the support and the rotation support plate to urge the press roller against the feed roller.

19. The separating apparatus according to claim 16, further comprising a sensor unit provided immediately before the feed roller, for detecting a position of a tip portion of the punched sheet and a controller for controlling the actuator, based on a signal from the sensor unit, to move the press rollers and the separation helping devices.

20. The separating apparatus according to claim 19, wherein the controller controls the actuator so that, based on a detection signal of the tip portion of the punched sheet from the sensor unit, the actuator actuates one of the press rollers and one of the separation helping devices to move 90° from a separation start position and, based on a detection signal of a rear portion of the punched sheet from the sensor unit, the actuator actuates the other of the press rollers and the other of the separation helping devices to move 90° to the separation start position.

* * * * *

UNITED STATES PATENT AND TRADEMARK OFFICE

CERTIFICATE OF CORRECTION

PATENT NO. : 5,470,004

DATED : NOVEMBER 28, 1995

INVENTOR(S) : Ryohachi MINEKI

It is certified that error appears in the above-indentified patent and that said Letters Patent is hereby corrected as shown below:

On the title page, item [*],

In the Notice in the above patent following item [73], the portion of the term of the patent which has been disclaimed should be changed from "June 15, 2010" to -- April 14, 2012 --

Signed and Sealed this

Thirtieth Day of April, 1996

*Attest:*

*Attesting Officer*

BRUCE LEHMAN

*Commissioner of Patents and Trademarks*